US011167543B1

(12) United States Patent
Alonso

(10) Patent No.: US 11,167,543 B1
(45) Date of Patent: Nov. 9, 2021

(54) MANUAL SQUEEGEE SYSTEM

(71) Applicant: Dagoberto Alonso, Channelview, TX (US)

(72) Inventor: Dagoberto Alonso, Channelview, TX (US)

( * ) Notice: Subject to any disclaimer, the term of this patent is extended or adjusted under 35 U.S.C. 154(b) by 308 days.

(21) Appl. No.: 16/364,428

(22) Filed: Mar. 26, 2019

(51) Int. Cl.

| | |
|---|---|
| ***B41F 15/40*** | (2006.01) |
| ***B41F 15/42*** | (2006.01) |
| ***B41F 15/44*** | (2006.01) |
| ***B41F 31/04*** | (2006.01) |
| ***B41F 15/02*** | (2006.01) |
| ***B41F 15/14*** | (2006.01) |
| ***B41F 15/36*** | (2006.01) |

(52) U.S. Cl.
CPC ..... *B41F 15/44* (2013.01); *B41F 15/02* (2013.01); *B41F 15/14* (2013.01); *B41F 15/36* (2013.01); *B41F 31/04* (2013.01)

(58) Field of Classification Search
CPC ..... B41F 15/02; B41F 15/14; B41F 15/36; B41F 15/40; B41F 15/42; B41F 15/44; B41F 15/46
USPC ..... 101/123
See application file for complete search history.

(56) References Cited

U.S. PATENT DOCUMENTS

| | | | | |
|---|---|---|---|---|
| 2,704,510 A | | 3/1955 | Walsh | |
| 2,783,709 A | * | 3/1957 | Thomas | B41F 15/423 101/123 |
| 2,881,698 A | * | 4/1959 | Graham | B41F 15/44 101/123 |
| 3,943,849 A | | 3/1976 | Vasilantone | |
| 4,648,317 A | | 5/1987 | Bubley | |
| 4,779,529 A | | 10/1988 | Edricsson | |
| 5,275,098 A | * | 1/1994 | Larson | B41F 15/423 101/114 |
| 5,791,243 A | | 8/1998 | Marcoux | |
| D404,062 S | | 1/1999 | Walle | |
| 7,127,988 B2 | | 10/2006 | Edson | |
| 2016/0200096 A1 | | 7/2016 | Kuroda | |

FOREIGN PATENT DOCUMENTS

| | | |
|---|---|---|
| WO | 2009035136 | 3/2009 |

* cited by examiner

*Primary Examiner* — Leslie J Evanisko

(57) ABSTRACT

The manual squeegee system applies one or more layers of inks to a targeted screen of a manual screen printing device. The manual squeegee system mechanically adjustably fixes the application pressure and the angle of attack of each of the one or more layers of inks. The manual squeegee system comprises a frame, a jib, a trolley, a plurality of slings, and a blade structure. The blade structure applies the one or more layers of inks at a consistent application pressure and the angle of attack. The plurality of slings attach the blade structure to the trolley. The trolley attaches the plurality of slings and the blade structure to the jib such that the position of the blade structure can be adjusted relative to the jib. The jib attaches the trolley to the frame. The frame attaches the manual squeegee system to the manual screen printing device.

12 Claims, 3 Drawing Sheets

MANUAL SQUEEGEE SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of performing operations including printing machines, more specifically, squeegee based inking unit for a screen printing machine.

SUMMARY OF INVENTION

The manual squeegee system is configured for use with a screen printing system. The manual squeegee system attaches to the frame of a manual screen printing device that holds a screen targeted for printing in position. The manual squeegee system applies one or more layers of one or more inks to the targeted screen. The manual squeegee system mechanically fixes the application pressure and the angle of attack of each of the one or more layers of the one or more inks to ensure even application of the one or more inks. The application pressure and the angle of the attack of the application of the one or more layers of the one or more inks is adjustable. The manual squeegee system comprises a frame, a jib, a trolley, a plurality of slings, and a blade structure. The blade structure is the mechanical device that applies the one or more layers of the one or more inks at a consistent application pressure and angle of attack. The plurality of slings attach the blade structure to the trolley. The trolley attaches the plurality of slings and the blade structure to the jib such that the position of the blade structure can be adjusted relative to the jib. The jib attaches the trolley to the frame. The frame attaches the manual squeegee system to the manual screen printing device.

These together with additional objects, features and advantages of the manual squeegee system will be readily apparent to those of ordinary skill in the art upon reading the following detailed description of the presently preferred, but nonetheless illustrative, embodiments when taken in conjunction with the accompanying drawings.

In this respect, before explaining the current embodiments of the manual squeegee system in detail, it is to be understood that the manual squeegee system is not limited in its applications to the details of construction and arrangements of the components set forth in the following description or illustration. Those skilled in the art will appreciate that the concept of this disclosure may be readily utilized as a bias for the design of other structures, methods, and systems for carrying out the several purposes of the manual squeegee system.

It is therefore important that the claims be regarded as including such equivalent construction insofar as they do not depart from the spirit and scope of the manual squeegee system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
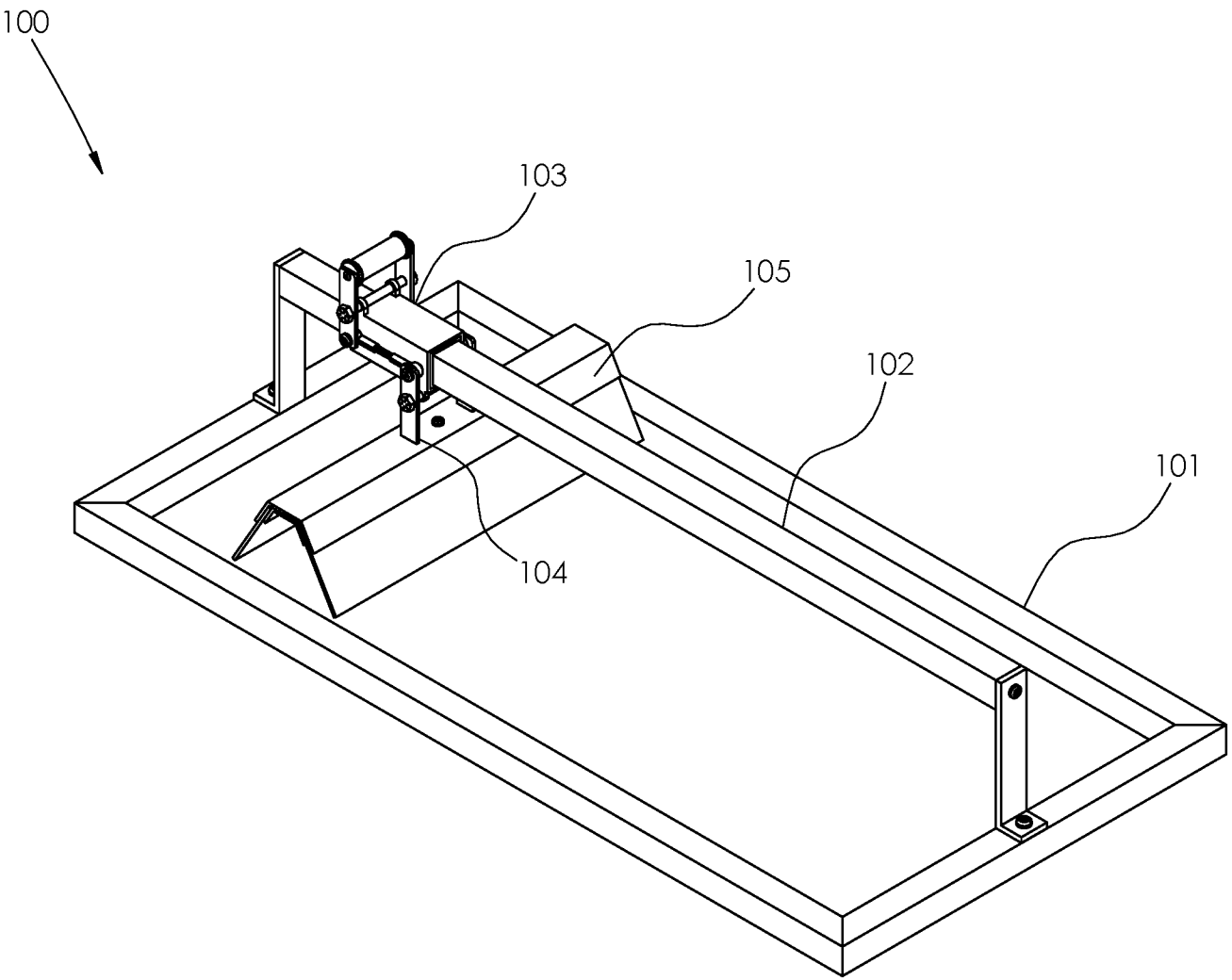
FIG. 1 is a perspective view of an embodiment of the disclosure.
Figure 2:
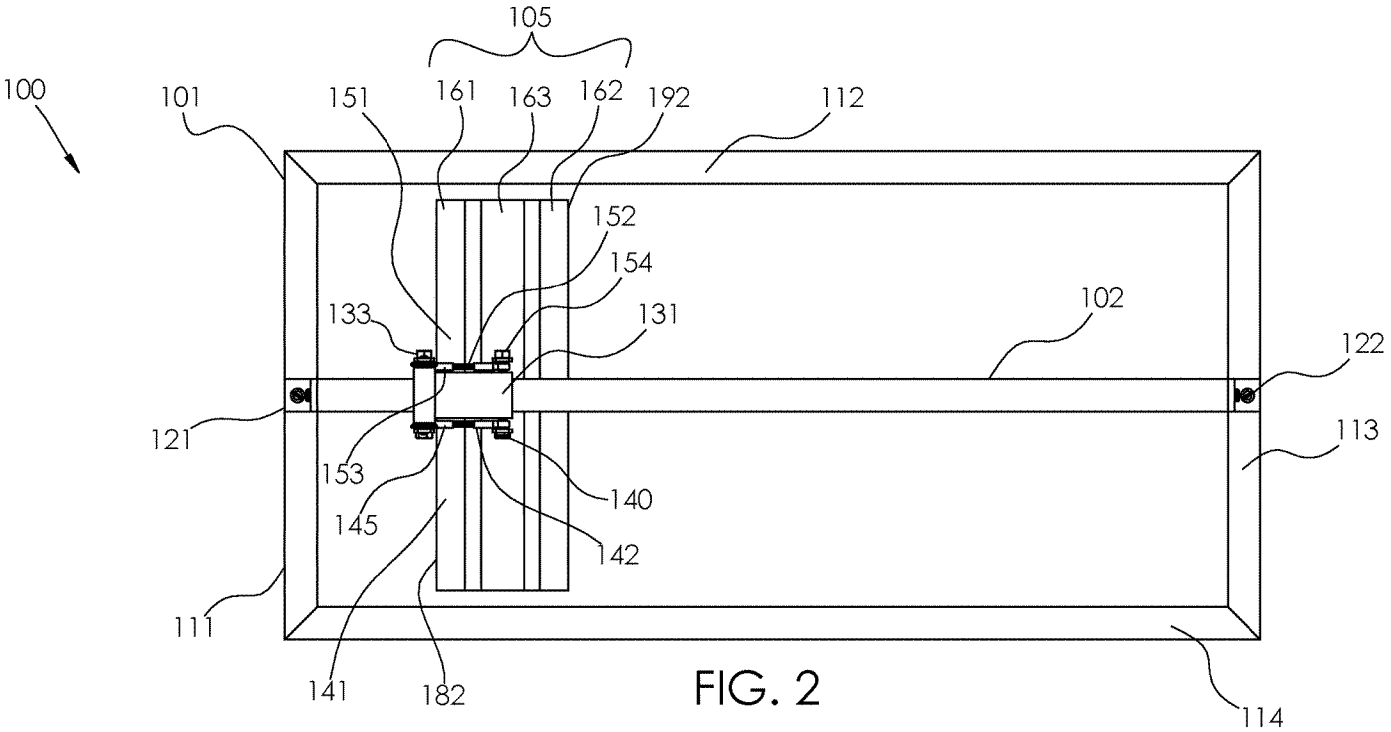
FIG. 2 is a top view of an embodiment of the disclosure.
Figure 3:
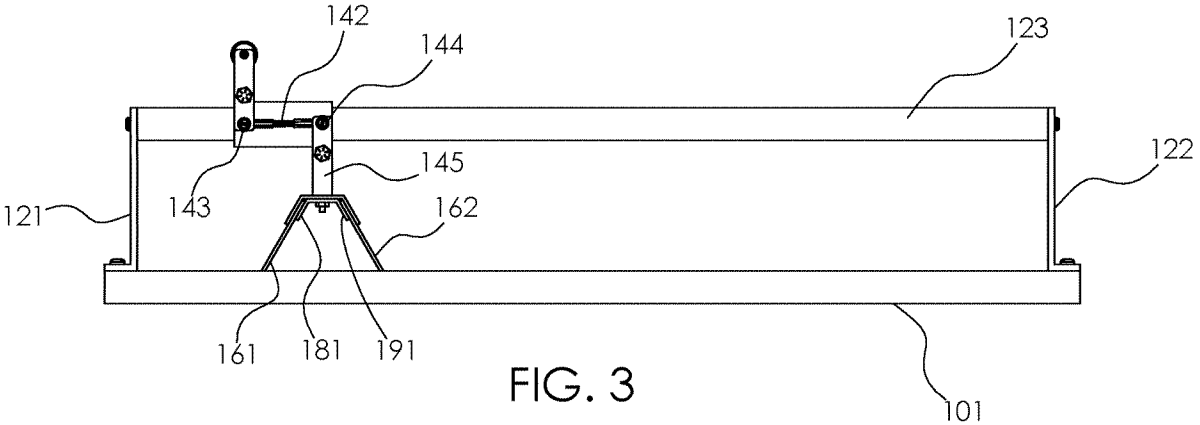
FIG. 3 is a side view of an embodiment of the disclosure.
Figure 4:
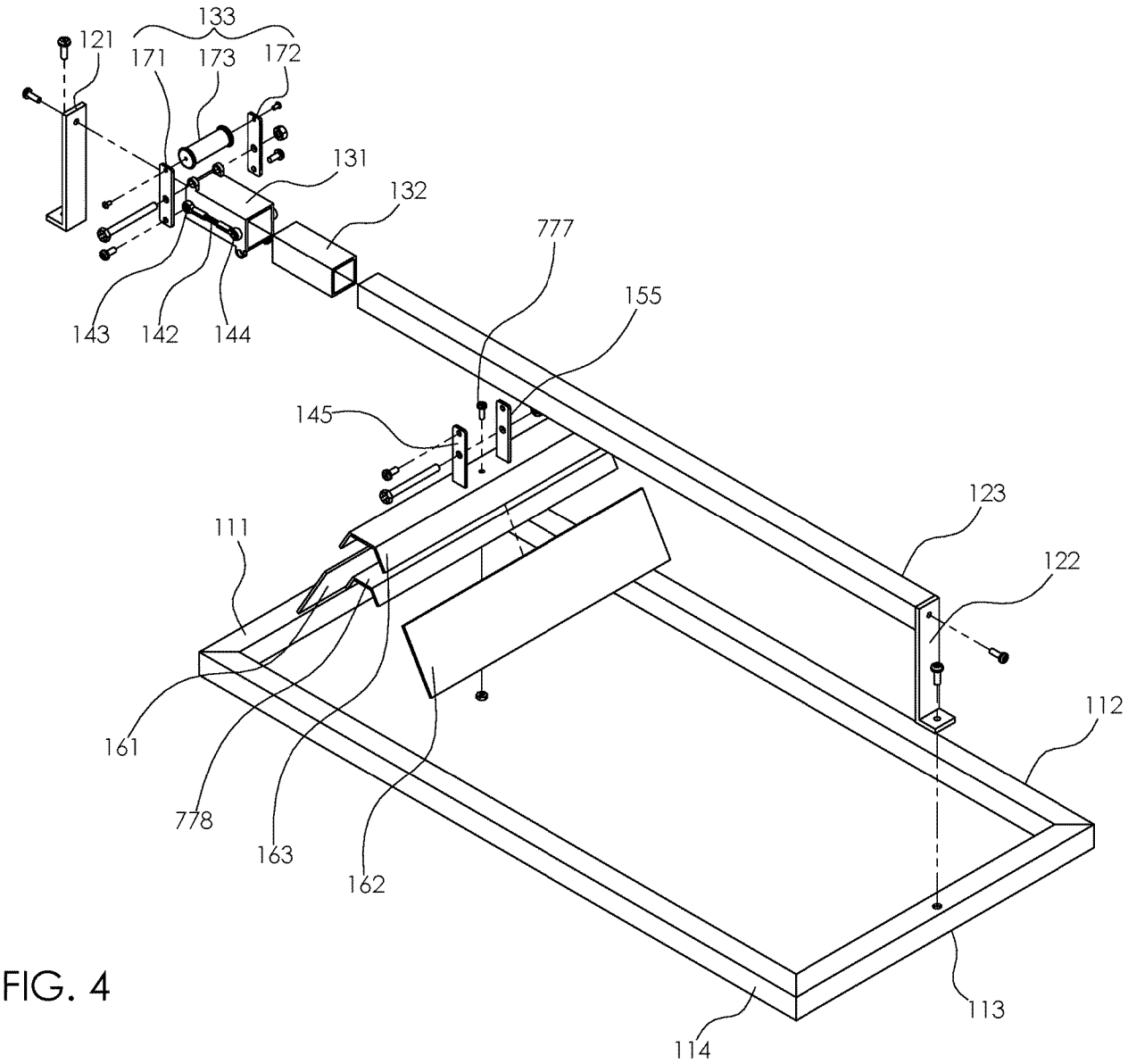
FIG. 4 is an exploded view of an embodiment of the disclosure.

Detailed reference will now be made to one or more potential embodiments of the disclosure, which are illustrated in FIGS. 1 through 4.

The manual squeegee system 100 (hereinafter invention) is configured for use with a screen printing system. The invention 100 attaches to the frame 101 of a manual screen printing device that holds a screen targeted for printing in position. The invention 100 applies one or more layers of one or more inks to the targeted screen. The invention 100 mechanically fixes the application pressure and the angle of attack of each of the one or more layers of the one or more inks to ensure even application of the one or more inks. The application pressure and the angle of attack of the application of the one or more layers of the one or more inks is adjustable. The invention 100 comprises the frame 101, a jib 102, a trolley 103, a plurality of slings 104, and a blade structure 105. The blade structure 105 is the mechanical device that applies the one or more layers of the one or more inks at a consistent application pressure and angle of attack. The plurality of slings 104 attach the blade structure 105 to the trolley 103. The trolley 103 attaches the plurality of slings 104 and the blade structure 105 to the jib 102 such that the position of the blade structure 105 can be adjusted relative to the jib 102. The jib 102 attaches the trolley 103 to the frame 101. The frame 101 attaches the invention 100 to the manual screen printing device.

The frame 101 is a rectangular structure. The frame 101 is a ring structure. The frame 101 is part of a manual screen printing device. The frame 101 is a weighted structure that holds in position a targeted screen intended to receive a printed image. The balance of the invention 100 mounts on the superior surfaces of the frame 101. The frame 101 comprises a first edge 111, a second edge 112, a third edge 113, and a fourth edge 114.

The first edge 111 is a square tube structure. The first edge 111 forms the shortest edge of the rectangular structure of the frame 101. The first edge 111 forms a portion of the perimeter of the frame 101. The second edge 112 is a square tube structure. The second edge 112 forms the longest edge of the rectangular structure of the frame 101. The second edge 112 forms a portion of the perimeter of the frame 101. The third edge 113 is a square tube structure. The third edge 113 is the edge of the frame 101 that is distal from the first edge 111. The third edge 113 forms a portion of the perimeter of the frame 101. The fourth edge 114 is a square tube structure. The fourth edge 114 is the edge of the frame 101 that is distal from the second edge 112. The fourth edge 114 forms a portion of the perimeter of the frame 101.

The jib 102 is a raised structure that attaches directly to the frame 101. The jib 102 projects away from the superior surface of the frame 101. The jib 102 suspends the trolley 103, the plurality of slings 104, and the blade structure 105 above the frame 101. The jib 102 comprises a first stanchion 121, a second stanchion 122, and a track 123.

The first stanchion 121 is a prism-shaped post that attaches to the superior surface of the first edge 111 of the frame 101. The first stanchion 121 attaches at the center of the superior surface of the first edge 111. The first stanchion 121 projects perpendicularly away from the first edge 111 in the manner of a cantilever. The first stanchion 121 forms an extension structure that raises the track 123 above the frame 101.

The second stanchion 122 is a prism-shaped post that attaches to the superior surface of the second edge 112 of the frame 101. The second stanchion 122 attaches at the center of the superior surface of the third edge 113. The second stanchion 122 projects perpendicularly away from the third edge 113 in the manner of a cantilever. The second stanchion 122 forms an extension structure that raises the track 123 above the frame 101.

The span of the length of the center axis of the first stanchion 121 is identical to the span of the length of the center axis of the second stanchion 122.

The track 123 is a square tube structure. The track 123 guides the direction of the movement of the trolley 103. The track 123 attaches to the free end of the first stanchion 121. The track 123 attaches to the free end of the second stanchion 122.

The trolley 103 is a mechanical structure. The trolley 103 attaches to the jib 102 such that the position of the trolley 103 relative to the frame 101 is adjustable. The trolley 103 suspends the plurality of the slings 104 and the blade structure 105 above the frame 101. The trolley 103 comprises a slide tube 131, an ST insert 132, and an ST handle 133.

The slide tube 131 is a hollow square tube structure. The ST insert 132 is a hollow square tube structure. The outer dimension of the ST insert 132 is less than the inner dimension of the slide tube 131 such that the ST insert 132 inserts into the slide tube 131. The inner dimension of the ST insert 132 is greater than the outer dimension of the track 123 such that the track 123 inserts into the combined ST insert 132 and slide tube 131 structure. The ST insert 132 is formed from a nylon polymer such that the track 123 slides smoothly through the ST insert 132.

The ST handle 133 is a hyoid shaped structure. The ST handle 133 attaches to the exterior surface of the slide tube 131. The ST handle 133 forms a grip used to draw the combination of the slide tube 131 and the ST insert 132 along the track 123. The ST handle 133 allows for the adjustment of the position of the combination of the slide tube 131 and the ST insert 132 relative to the track 123. The ST handle 133 comprises a first handle arm 171, a second handle arm 172, and a handle crossbeam 173.

The first handle arm 171 refers to the first arm of the hyoid structure of the ST handle 133. The first handle arm 171 is an extension structure that separates the handle crossbeam 173 from the slide tube 131. The second handle arm 172 refers to the second arm of the hyoid structure of the ST handle 133. The second handle arm 172 is an extension structure that separates the handle crossbeam 173 from the slide tube 131. The handle crossbeam 173 forms the grip of the ST handle 133. The free end of the first handle arm 171 attaches to the slide tube 131. The free end of the second handle arm 172 attaches to the slide tube 131.

Each of the plurality of slings 104 is a mechanical structure. The plurality of slings 104 attach the blade structure 105 to the trolley 103. Each of the plurality of slings 104 is an adjustable structure. By adjustable is meant that the plurality of slings 104 can change the application pressure and the angle of attack used on the one or more layers of the one or more inks applied to the targeted screen. The plurality of slings 104 comprises a first sling 141 and a second sling 151.

The first sling 141 is a mechanical device. The first sling 141 attaches the blade structure 105 to the trolley 103. The first sling 141 mechanically adjusts the angle of attack of the blade structure 105. The first sling 141 comprises a first turnbuckle 142, a first fixed mount 143, a first pivot mount 144, and a first suspending arm 145.

The first turnbuckle 142 is a commercially available turnbuckle. The first turnbuckle 142 attaches the first fixed mount 143 to the first pivot mount 144. The first fixed mount 143 is an anchor point that permanently affixes to the exterior surface of the slide tube 131. The first pivot mount 144 is a rotating structure that attaches to the exterior surface of the slide tube 131. The first suspending arm 145 is a prism-shaped shaft that attaches to the first pivot mount 144. The first suspending arm 145 attaches to the first pivot mount 144 such that the rotation of the first pivot mount 144 adjusts the direction of the center axis of the first suspending arm 145 relative to the force of gravity which in turn adjusts the application pressure and the angle of attack of the blade structure 105. The first pivot mount 144 rotates by adjusting the span of the length of the first turnbuckle 142.

The second sling 151 is a mechanical device. The second sling 151 attaches the blade structure 105 to the trolley 103. The second sling 151 mechanically adjusts such that the angle of attack of the blade structure 105. The second sling 151 comprises a second turnbuckle 152, a second fixed mount 153, a second pivot mount 154, and a second suspending arm 155.

The second turnbuckle 152 is a commercially available turnbuckle. The second turnbuckle 152 attaches the second fixed mount 153 to the second pivot mount 154. The second fixed mount 153 is an anchor point that permanently affixes to the exterior surface of the slide tube 131. The second pivot mount 154 is a rotating structure that attaches to the exterior surface of the slide tube 131. The second suspending arm 155 is a prism-shaped shaft that attaches to the second pivot mount 154. The second suspending arm 155 attaches to the second pivot mount 154 such that the rotation of the second pivot mount 154 adjusts the direction of the center axis of the second suspending arm 155 relative to the force of gravity which in turn adjusts the application pressure and the angle of attack of the blade structure 105. The second pivot mount 154 rotates by adjusting the span of the length of the second turnbuckle 152.

The first sling 141 and the second sling 151 are identical. The second sling 151 attaches to the face of the slide tube 131 that is distal from the second sling 151.

The blade structure 105 is a trough-shaped structure. The blade structure 105 is a bladed device commonly referred to as a squeegee. The blade structure 105 is formed as a trough structure. The blade structure 105 applies the one or more layers of the one or more inks to the targeted screen as an even coating. The blade structure 105 is a rotating structure. The rotation of the blade structure 105 adjusts the application pressure and the angle of attack during the application of the one or more layers of the one or more inks to the targeted screen. The blade structure 105 comprises a first plate 161, a second plate 162, and a cross-plate 163. The first plate 161, the second plate 162, and the cross-plate 163 are joined to form the trough structure of the blade structure 105. The first plate 161 comprises a first cant 181 and a first rubber blade 182. The second plate 162 comprises a second cant 191 and a second rubber blade 192.

The cross-plate 163 is a rectangular block structure, which is bolted to a bottom cross-plate 778 in order to secure the first plate 161 and the second plate 162 to the blade structure 105. The cross-plate 163 is secured to the bottom cross-plate 778 via at least one bolt 777. The cross-plate 163 attaches the first plate 161 to the second plate 162. The second plate 162 attaches to the edge of the cross-plate 163 that is distal from the attachment edge of the first plate 161. The first suspending arm 145 of the first sling 141 attaches to the superior surface of the cross-plate 163. The second suspending arm 155 of the second sling 151 attaches to the superior surface of the cross-plate 163. The superior surface of the cross-plate 163 is the surface that is proximal to the track 123. The inferior surface of the cross-plate 163 is distal from the superior surface of the cross-plate 163.

The first plate 161 projects away from the inferior surface of the cross-plate 163. The first plate 161 projects away from the cross-plate 163 at an angle that forms the first cant 181. The second plate 162 projects away from the inferior surface of the cross-plate 163. The second plate 162 projects away from the cross-plate 163 at an angle that forms the second cant 191. The span of the arc of the first cant 181 does not equal the span of the arc of the second cant 191.

The first rubber blade 182 is the characteristic rubber blade used to form a squeegee. The first rubber blade 182 attaches to the edge of the first plate 161 that is distal from the edge of the first plate 161 that attaches to the cross-plate 163. The second rubber blade 192 is the characteristic rubber blade used to form a squeegee. The second rubber blade 192 attaches to the edge of the second plate 162 that is distal from the edge of the second plate 162 that attaches to the cross-plate 163.

The application pressure and the angle of attack of the first rubber blade 182 against the targeted screen is a function of the span of the arc of the first cant 181. The application pressure and the angle of attack of the second rubber blade 192 against the targeted screen is a function of the span of the arc of the second cant 191. The application pressure and the angle of attack is determined by selecting a blade from the group consisting of the first rubber blade 182 and the second rubber blade 192.

By adjusting the length of both the first turnbuckle 142 and the second turnbuckle 152, the angle of the superior face of the cross-plate 163 changes such that a blade selected from the group consisting of the first rubber blade 182 and the second rubber blade 192 is placed in contact with the targeted screen. This adjustment creates the adjustment of the application pressure and the angle of attack of the one or more layers of the one or more inks on the targeted screen that is described in this disclosure.

The following definitions were used in this disclosure:

Anchor: As used in this disclosure, anchor means to hold an object firmly or securely.

Anchor Point: As used in this disclosure, an anchor point is a location to which a first object can be securely attached to a second object.

Angle of Attack: As used in this disclosure, the angle of attack refers to the angle formed between the direction of motion relative to a reference line or plane.

Beam: As used in this disclosure, a beam is a horizontally oriented shaft that: 1) is suspended above a supporting surface; and, 2) bears a load.

Blade: As used in this disclosure, a blade is a term that is used to describe: 1) a wide and flat portion of a structure; or, 2) the cutting edge of a tool.

Bolt: As used in this disclosure, a bolt is a cylindrical shaft that is formed with an exterior screw thread. A bolt is defined with an outer diameter.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Coating: As used in this disclosure, a coating refers to a substance that is applied to the exterior surface of an object such that the coating forms a new exterior surface of the object. A coating is commonly said to be formed as a layer. Paint is an example of a common coating material.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Cord: As used in this disclosure, a cord is a long, thin, flexible, and prism-shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Extension Structure: As used in this disclosure, an extension structure is an inert physical structure that is used to extend the span of the distance between any two objects.

Eyebolt: As used in this disclosure, an eyebolt is a bolt that is formed with a ring at one end. The ring is commonly referred to as an eyelet.

Force of Gravity: As used in this disclosure, the force of gravity refers to a vector that indicates the direction of the pull of gravity on an object at or near the surface of the earth.

Hyoid: As used in this disclosure, a hyoid refers to a three-sided structure comprising a crossbeam, a first arm, and a second arm. In a hyoid, the first arm and the second arm project away from the crossbeam: 1) in the same direction; 2) at a roughly perpendicular angle to the crossbeam, and, 3) the span of the length of the first arm roughly equals the span of the length of the second arm. Hyoids generally have a U shaped appearance.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Jib: As used in this disclosure, a jib is a beam structure that: 1) is mounted with a free end in the manner of a cantilever; and, 2) suspends a load at the free end of the jib. In multicomponent beam structures, such as with a crane, the jib is the sub-structure that physically suspends the load.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Overlay: As used in this disclosure, an overlay refers to the placement of a second sign over a first sign such that: a) a portion of the sentiment presented by the first sign is visible through the second sign; and, b) the sentiment of the second sign supplements the sentiment presented by the first sign.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Ring: As used in this disclosure, a ring is a term that is used to describe a flat or plate-like structure through which an aperture is formed. Rings are often considered loops.

Shaft: As used in this disclosure, a shaft is a long, narrow and rigid prism (or composite prism) structure that is used as: 1) a structural element of a larger object; or 2) as a grip or lever for a handle. Shafts often have a cylindrical shape.

Slide: As used in this disclosure, slide is a verb that refers to an object that is transported along a surface while in continuous contact with the surface. An object being transported along a surface with wheels cannot be said to be sliding.

Sling: As used in this disclosure, a sling refers to a structure that is used to support, cradle or hoist an object, generally from above.

Squeegee: As used in this disclosure, a squeegee is a T shaped tool formed with a rubber-edged crosspiece that is used for removing water from a window.

Superior: As used in this disclosure, the term superior refers to a directional reference that is parallel to and in the opposite direction of the force of gravity when an object is positioned or used normally.

Suspend: As used in this disclosure, to suspend an object means to support an object such that the inferior end of the object does not form a significant portion of the load path of the object.

Threaded Connection: As used in this disclosure, a threaded connection is a type of fastener that is used to join a first tube-shaped and a second tube-shaped object together. The first tube-shaped object is fitted with a first fitting selected from an interior screw thread or an exterior screw thread. The second tube-shaped object is fitted with the remaining screw thread. The tube-shaped object fitted with the exterior screw thread is placed into the remaining tube-shaped object such that: 1) the interior screw thread and the exterior screw thread interconnect; and, 2) when the tube-shaped object fitted with the exterior screw thread is rotated the rotational motion is converted into linear motion that moves the tube-shaped object fitted with the exterior screw thread either into or out of the remaining tube-shaped object. The direction of linear motion is determined by the direction of rotation.

Track: As used in this disclosure, a track is a structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

Trough: As used in this disclosure, a trough refers to a three-sided structure comprising a cross-plate, a first plate, and a second plate. In a trough, the first trough and the second trough project away from the cross-plate in the same direction. The span of the length of the first plate roughly equals the span of the length of the second plate. Troughs generally have a U shaped appearance. A gutter is an example of a trough.

Trolley: As used in this disclosure, a trolley is a mechanical structure that suspends an object to a jib or a track such that the position of the object relative to the jib or track is adjustable.

Tube: As used in this disclosure, the term tube is used to describe a rigid hollow prism with two open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Turnbuckle: As used in this disclosure, a turnbuckle is a hardware item that comprises two eyebolts and a metal frame. The two eyebolts screw into the metal frame. The turnbuckle is used to: a) adjusts the tension on a cord; or, b) adjust the overall span of the length between the eyelets of the two eyebolts.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A squeegee based inking unit comprising:

a frame, a jib, a trolley, a plurality of slings, and a blade structure;

wherein the frame comprises a first edge, a second edge, a third edge, and a fourth edge;

wherein the plurality of slings attach the blade structure to the trolley;

wherein the trolley attaches the plurality of slings and the blade structure to the jib;

wherein the jib attaches the trolley to the frame;

wherein the frame is associated with a manual screen printing device;

wherein the frame attaches the squeegee based inking unit to the manual screen printing device;

wherein the squeegee based inking unit applies one or more layers of one or more inks to a targeted screen;

wherein the jib comprises a first stanchion, a second stanchion, and a track;

wherein the first stanchion forms an extension structure that raises the track above the frame;

wherein the second stanchion forms an extension structure that raises the track above the frame;

wherein the track is a square tube structure;

wherein the track guides the direction of the movement of the trolley;

wherein the first stanchion is a prism-shaped post;

wherein the first stanchion attaches to the superior surface of the first edge of the frame;

wherein the second stanchion is a prism-shaped post;

wherein the second stanchion attaches to the superior surface of the third edge of the frame;

wherein the application pressure and the angle of attack of the application of the one or more layers of the one or more inks is adjustable;

wherein the blade structure applies the one or more layers of the one or more inks at a consistent application pressure and angle of attack;

wherein the trolley attaches the plurality of slings and the blade structure to the jib such that the position of the blade structure can be adjusted relative to the jib;

wherein the frame is a rectangular structure;

wherein the balance of the squeegee based inking unit mounts on the superior surfaces of the frame;

wherein the jib is a raised structure that attaches directly to the frame;

wherein the jib projects away from the superior surface of the frame;

wherein the jib suspends the trolley, the plurality of slings, and the blade structure above the frame;

wherein the trolley is a mechanical structure that attaches to the jib such that the position of the trolley relative to the frame is adjustable;

wherein the trolley suspends the plurality of slings and the blade structure above the frame;

wherein each of the plurality of slings is a mechanical structure;

wherein the plurality of slings attach the blade structure to the trolley;

wherein each of the plurality of slings is an adjustable structure;

wherein the blade structure is a bladed device commonly referred to as a squeegee;

wherein the blade structure is formed as a trough structure;

wherein the blade structure applies the one or more layers of the one or more inks to the targeted screen as an even coating;

wherein the blade structure is a rotating structure;

wherein the rotation of the blade structure adjusts the application pressure and the angle of attack during the application of the one or more layers of the one or more inks to the targeted screen.

2. The squeegee based inking unit according to claim 1 wherein the first edge is a square tube structure;

wherein the second edge is a square tube structure;

wherein the third edge is a square tube structure;

wherein the fourth edge is a square tube structure;

wherein the first edge forms the shortest edge of the rectangular structure of the frame;

wherein the second edge forms the longest edge of the rectangular structure of the frame;

wherein the third edge is the edge of the frame that is distal from the first edge;

wherein the fourth edge is the edge of the frame that is distal from the second edge.

3. The squeegee based inking unit according to claim 2
wherein the first stanchion attaches at the center of the superior surface of the first edge;
wherein the first stanchion projects perpendicularly away from the first edge in the manner of a cantilever;
wherein the second stanchion attaches at the center of the superior surface of the third edge;
wherein the second stanchion projects perpendicularly away from the third edge in the manner of a cantilever.

4. The squeegee based inking unit according to claim 3 wherein the span of the length of the center axis of the first stanchion is identical to the span of the length of the center axis of the second stanchion.

5. The squeegee based inking unit according to claim 4
wherein the track attaches to the free end of the first stanchion;
wherein the track attaches to the free end of the second stanchion.

6. The squeegee based inking unit according to claim 5
wherein the trolley comprises a slide tube, an ST insert, and an ST handle;
wherein the slide tube is a hollow square tube structure;
wherein the ST insert is a hollow square tube structure;
wherein the outer dimension of the ST insert is less than the inner dimension of the slide tube such that the ST insert inserts into the slide tube;
wherein the inner dimension of the ST insert is greater than the outer dimension of the track such that the track inserts into the combined ST insert and slide tube structure;
wherein the ST insert is formed from a nylon polymer;
wherein the ST handle attaches to the exterior surface of the slide tube;
wherein the ST handle is a hyoid shaped structure;
wherein the ST handle allows for the adjustment of the position of the combination of the slide tube and the ST insert relative to the track.

7. The squeegee based inking unit according to claim 6
wherein the ST handle comprises a first handle arm, a second handle arm, and a handle crossbeam;
wherein the first handle arm refers to the first arm of the hyoid structure of the ST handle;
wherein the second handle arm refers to the second arm of the hyoid structure of the ST handle;
wherein the first handle arm is an extension structure that separates the handle crossbeam from the slide tube;
wherein the second handle arm is an extension structure that separates the handle crossbeam from the slide tube;
wherein the handle crossbeam forms the grip of the ST handle;
wherein the free end of the first handle arm attaches to the slide tube;
wherein the free end of the second handle arm attaches to the slide tube.

8. The squeegee based inking unit according to claim 7
wherein the plurality of slings comprises a first sling and a second sling;
wherein the first sling is a mechanical device;
wherein the first sling attaches the blade structure to the trolley;
wherein the second sling is a mechanical device;
wherein the second sling attaches the blade structure to the trolley;
wherein the first sling mechanically adjusts the angle of attack of the blade structure;
wherein the second sling mechanically adjusts such that the angle of attack of the blade structure.

9. The squeegee based inking unit according to claim 8
wherein the first sling comprises a first turnbuckle, a first fixed mount, a first pivot mount, and a first suspending arm;
wherein the second sling comprises a second turnbuckle, a second fixed mount, a second pivot mount, and a second suspending arm;
wherein the first turnbuckle attaches the first fixed mount to the first pivot mount;
wherein the second turnbuckle attaches the second fixed mount to the second pivot mount;
wherein the first fixed mount is an anchor point that permanently affixes to the exterior surface of the slide tube;
wherein the second fixed mount is an anchor point that permanently affixes to the exterior surface of the slide tube;
wherein the first pivot mount is a rotating structure that attaches to the exterior surface of the slide tube;
wherein the second pivot mount is a rotating structure that attaches to the exterior surface of the slide tube;
wherein the first suspending arm is a prism-shaped shaft that attaches to the first pivot mount;
wherein the second suspending arm is a prism-shaped shaft that attaches to the second pivot mount;
wherein the first suspending arm attaches to the first pivot mount such that the rotation of the first pivot mount adjusts the direction of the center axis of the first suspending arm relative to the force of gravity which in turn adjusts the application pressure and the angle of attack of the blade structure;
wherein the second suspending arm attaches to the second pivot mount such that the rotation of the second pivot mount adjusts the direction of the center axis of the second suspending arm relative to the force of gravity which in turn adjusts the application pressure and the angle of attack of the blade structure;
wherein the first pivot mount rotates by adjusting the span of the length of the first turnbuckle;
wherein the second pivot mount rotates by adjusting the span of the length of the second turnbuckle.

10. The squeegee based inking unit according to claim 9
wherein the first sling and the second sling are identical;
wherein the second sling attaches to the face of the slide tube that is distal from the second sling.

11. The squeegee based inking unit according to claim 10
wherein the blade structure comprises a first plate, a second plate, a cross-plate, and a bottom cross-plate;
wherein the first plate, the second plate, and the cross-plate, the bottom cross-plate are joined to form the trough structure of the blade structure;
wherein the cross-plate is a rectangular block structure;
wherein the cross-plate attaches the first plate to the second plate;
wherein the second plate attaches to the edge of the cross-plate that is distal from the attachment edge of the first plate;
wherein the first suspending arm of the first sling attaches to the superior surface of the cross-plate;
wherein the second suspending arm of the second sling attaches to the superior surface of the cross-plate;
wherein the superior surface of the cross-plate is the surface that is proximal to the track;
wherein the inferior surface of the cross-plate is distal from the superior surface of the cross-plate;
wherein the first plate projects away from the inferior surface of the cross-plate;

wherein the second plate projects away from the inferior surface of the cross-plate.

12. The squeegee based inking unit according to claim 11 wherein the first plate comprises a first cant and a first rubber blade;

wherein the second plate comprises a second cant and a second rubber blade;

wherein the cross-plate is bolted to the bottom cross-plate in order to secure the first plate and the second plate to the blade structure;

wherein the first plate projects away from the cross-plate at an angle that forms the first cant;

wherein the second plate projects away from the cross-plate at an angle that forms the second cant;

wherein the span of the arc of the first cant does not equal the span of the arc of the second cant;

wherein the first rubber blade is an elastomeric blade;

wherein the first rubber blade attaches to the edge of the first plate that is distal from the edge of the first plate that attaches to the cross-plate;

wherein the second rubber blade is an elastomeric blade;

wherein the second rubber blade attaches to the edge of the second plate that is distal from the edge of the second plate that attaches to the cross-plate;

wherein the application pressure and the angle of attack of the first rubber blade against the targeted screen is a function of the span of the arc of the first cant;

wherein the application pressure and the angle of attack of the second rubber blade against the targeted screen is a function of the span of the arc of the second cant;

wherein the application pressure and the angle of attack is determined by selecting a blade from the group consisting of the first rubber blade and the second rubber blade;

wherein by adjusting the length of both the first turnbuckle and the second turnbuckle, the angle of the superior face of the cross-plate changes such that a blade selected from the group consisting of the first rubber blade and the second rubber blade is placed in contact with the targeted screen.

* * * * *